US008534184B2

(12) United States Patent
Riley et al.

(10) Patent No.: US 8,534,184 B2
(45) Date of Patent: Sep. 17, 2013

(54) REPLACEABLE SLEEVE FOR A CYLINDER LINER

(75) Inventors: Andrew Dale Riley, Eufaula, OK (US); Clifton D. Eggleston, McAlester, OK (US)

(73) Assignee: National Oilwell Varco, L.P., Houston, TX (US)

( * ) Notice: Subject to any disclaimer, the term of this patent is extended or adjusted under 35 U.S.C. 154(b) by 933 days.

(21) Appl. No.: 12/629,553

(22) Filed: Dec. 2, 2009

(65) Prior Publication Data

US 2010/0139928 A1 Jun. 10, 2010

Related U.S. Application Data

(60) Provisional application No. 61/119,189, filed on Dec. 2, 2008.

(51) Int. Cl.
*F01B 11/02* (2006.01)

(52) U.S. Cl.
USPC ..... 92/170.1; 92/171.1

(58) Field of Classification Search
USPC ..... 92/171.1, 170.1, 169.1, 128
See application file for complete search history.

(56) References Cited

U.S. PATENT DOCUMENTS

| | | | | |
|---|---|---|---|---|
| 3,682,572 | A | 8/1972 | Yarger | |
| 3,765,804 | A | 10/1973 | Brandon | |
| 4,822,261 | A | 4/1989 | Avery et al. | |
| 5,388,725 | A | 2/1995 | Lichfield | |
| 5,725,365 | A | 3/1998 | Solomon et al. | |
| 6,209,445 | B1 * | 4/2001 | Roberts et al. | 92/128 |
| 6,463,843 | B2 * | 10/2002 | Pippert | 92/170.1 |
| 6,588,318 | B2 * | 7/2003 | Aday et al. | 92/171.1 |
| 6,668,701 | B1 | 12/2003 | Everitt | |
| 7,114,574 | B2 * | 10/2006 | Bissonnette et al. | 166/386 |
| 7,234,388 | B2 | 6/2007 | Orr et al. | |
| 7,523,694 | B2 * | 4/2009 | Aday et al. | 92/171.1 |
| 2006/0287629 | A1 | 12/2006 | Denne | |

FOREIGN PATENT DOCUMENTS

WO 2005100795 A1 10/2005

* cited by examiner

*Primary Examiner* — Edward Look
*Assistant Examiner* — Logan Kraft
(74) *Attorney, Agent, or Firm* — Conley Rose, P.C.

(57) ABSTRACT

A pump cylinder liner apparatus includes a replaceable sleeve captured between two cylinder hull portions that are releasably coupled to allow access to the sleeve for replacement. An elastomeric material or tube may be disposed between the sleeve and the two coupled hull portions for radial compressive pre-loading of the sleeve upon assembly and during operation.

18 Claims, 4 Drawing Sheets

REPLACEABLE SLEEVE FOR A CYLINDER LINER

CROSS-REFERENCE TO RELATED APPLICATIONS

The present application claims the benefit of U.S. Provisional Application No. 61/119,189, filed Dec. 2, 2008, entitled "Replaceable Sleeve For A Cylinder Liner."

BACKGROUND

1. Field of the Disclosure

The disclosure relates generally to mud pumps. More particularly, the disclosure relates to cylinder sleeves of mud pumps. Still more particularly, the disclosure relates to a replaceable cylinder sleeve, and applying radially compressive pre-load to the replaceable sleeve.

2. Background of the Disclosure

In extracting hydrocarbons from the earth, it is common to drill a borehole into the earth formation containing the hydrocarbons. A drill bit is attached to a drill string, and during drilling operations, drilling fluid, or "mud" as it is also known, is pumped down through the drill string and into the hole through the drill bit. Drilling fluids are used to lubricate the drill bit and keep it cool. The drilling mud also cleans the bit, balances pressure by providing weight downhole, and brings sludge and cuttings created during the drilling process up to the surface. Finally, the drilling fluid can reveal the presence of oil, gas or water that may enter the fluid from a formation being drilled and may reveal information about the formation through drill cuttings. A viscous drilling fluid is capable of transporting more and heavier cuttings, so viscous drilling fluid can be advantageous, and often additives are utilized to increase viscosity.

Slush or mud pumps are commonly used for pumping the drilling mud. The pumps used in these applications are reciprocating pumps typically of the duplex or triplex type. A duplex pump has two reciprocating pistons that each force drilling mud into a discharge line, while a triplex reciprocating pump has three pistons that force drilling mud into a discharge line. These reciprocating mud pumps can be single acting, in which drilling mud is discharged on alternate strokes, or double acting, in which each stroke discharges drilling mud.

The pistons and cylinders used for such mud pumps are susceptible to a high degree of wear during use because the drilling mud is relatively dense and has a high proportion of suspended abrasive solids. This translates into a relatively short lifetime of the cylinder and necessitates frequent replacement of the cylinder. As the cylinder in which the piston reciprocates becomes worn, the small annular space between the piston head and the cylinder wall increases substantially and sometimes irregularly. This decreases the efficiency of the pump. To counteract the effect of this wear, mud pumps typically utilize of an expendable cylinder liner apparatus.

The general construction of a mud pump cylinder liner apparatus involves using three pieces of tubular material: a sleeve, a hull, and a collar. The sleeve forms the inside surface of the liner apparatus, the hull is assembled by shrink fit over the sleeve, and the collar is a flange ring that is shrink fit around the hull and normally retains the liner apparatus in the mud pump cylinder. The shrink fit between the sleeve and the hull creates a mechanical radial compressive pre-load on the sleeve and serves to counteract the effects of the alternating axial compressive forces and internal pressures on the cylinder sleeve which can lead to fatigue and failure of the cylinder sleeve and necessitate the replacement of the cylinder liner apparatus.

FIG. 1 illustrates an embodiment of a prior art cylinder liner apparatus 10 and includes clamping collar 20, cylinder hull 30, and sleeve 40. A central axis 15 passes through the longitudinal center of cylinder liner assembly 10. Annular clamping collar 20 is centered about central axis 15 and includes a collar bore 22 having an inner diameter 24. Cylinder hull 30 is concentrically disposed within collar bore 22 of clamping collar 20 to secure apparatus 10 to a fluid side of an existing mud pump module. Cylinder hull 30 includes a hull wall 32 having an outer diameter 34 and a hull bore 36 having an inner diameter 38. Further, hull wall 32 outer diameter 34 is larger than inner diameter 24 of collar bore 22 in clamping collar 20. Sleeve 40 is concentrically disposed within cylinder hull 30. Further, sleeve 40 includes a sleeve wall 42 with an outer diameter 44 that is larger than inner diameter 38 of cylinder bore 36 in cylinder hull 30, and an inner bore 41 for receiving the pump piston.

The motion of the reciprocating pump piston subjects the cylinder sleeve to alternating axial forces and internal pressures. The alternating internal pressures translate to alternating radial stresses in the cylinder sleeve that can lead to metal fatigue from the cyclic loading and sudden changes in direction of the piston motion. To counteract the effects of fatigue, radial compressive pre-load is applied to the cylinder sleeve such that the alternating internal pressure creates less fatigue stress in the sleeve than a sleeve with no pre-load. The radial compressive stresses are critical to ensure that the sleeve resists cyclic fatigue due to the cyclic pressures of the operating pump.

The method of imparting radial compressive pre-load using the prior art cylinder liner apparatus 10 includes heating cylinder hull 30 until inner diameter 38 of hull bore 36 is greater than outer diameter 44 of sleeve 40, then inserting sleeve 40 into hull bore 36. Next, cylinder hull 30 is cooled causing cylinder hull 30 to contract and decrease inner diameter 38 and radially contact and compress sleeve 40. Then, clamping collar 20 is heated until inner diameter 24 of collar bore 22 is greater than outer diameter 34 of outer wall 32. Cylinder hull 30 is inserted into collar bore 22, and clamping collar 20 is cooled to cause clamping collar 20 to contract and decrease inner diameter 24 and radially contact cylinder hull 30. Such a shrink fit cylinder liner assembly is complex and costly to manufacture. Further, the entire cylinder liner assembly 10 is discarded when only sleeve 40 wears out, thereby also adding to costs.

Accordingly, there remains a need in the art for cylinder liners that address the foregoing difficulties and overcomes other limitations of the prior art.

BRIEF DESCRIPTION OF THE DRAWINGS

For a more detailed description of the embodiments, reference will now be made to the accompanying figures, wherein.

DETAILED DESCRIPTION

Figure 1:
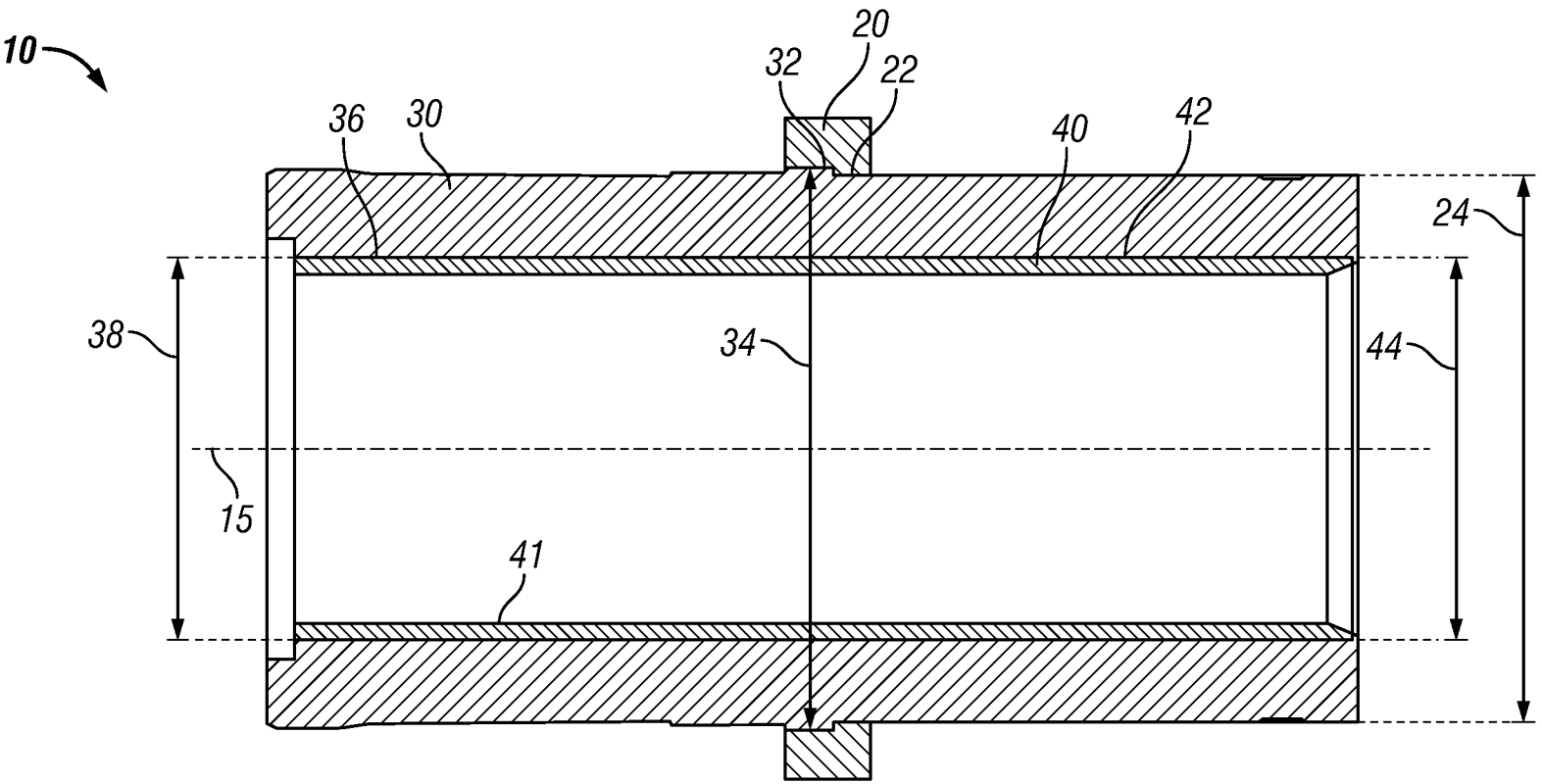
FIG. 1 (Prior Art)
FIG. 1 shows a cross-sectional view of a prior art cylinder liner apparatus.

In the drawings and description that follows like parts are marked throughout the specification and drawings with the same reference numerals. The drawing figures are not necessarily to scale. Features of the disclosure may be shown exaggerated in scale or in somewhat schematic form and some details of conventional elements may not be shown in the interest of clarity and conciseness. The disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments described and discussed herein may be employed separately or in any suitable combination to produce desired results.

Unless otherwise specified, any use of any form of the terms "connect", "engage", "couple", "attach", or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". The terms "pipe," "cylinder," "tubular member," and the like as used herein shall include tubing and other generally cylindrical objects. In addition, in the discussion and claims that follow, it may be sometimes stated that certain components or elements are in fluid communication. By this it is meant that the components are constructed and interrelated such that a fluid could be communicated between them, as via a passageway, tube, or conduit. The various characteristics mentioned above, as well as other features and characteristics described in more detail below, will be readily apparent to those skilled in the art upon reading the following detailed description of the embodiments, and by referring to the accompanying drawings.

Generally, the present disclosure includes a replaceable sleeve for use with a cylinder liner apparatus in a fluid end portion of a mud pump. More particularly, embodiments of the present disclosure include a replaceable sleeve disposed within a two-piece hull or housing. An elastomeric tube may be disposed between the hull and the sleeve, and the hull pieces forced together over the sleeve and elastomeric tube thereby imparting radial compressive pre-load to the replaceable sleeve.

Figure 2:
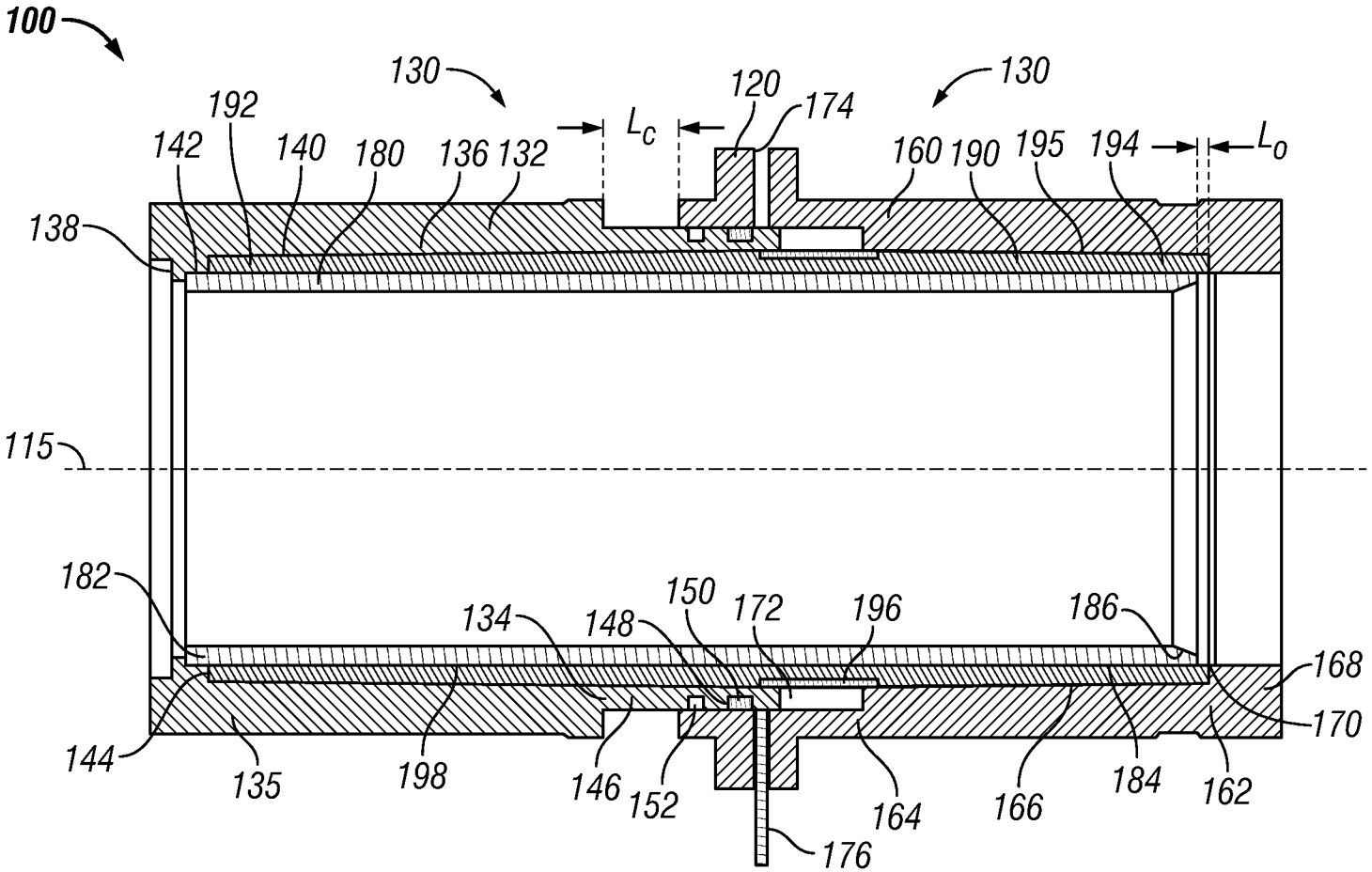
FIG. 2 shows a cross-sectional view of one embodiment of a cylinder liner apparatus employing a replaceable sleeve of the present disclosure, wherein the apparatus is in a loosely assembled configuration.

Referring now to FIG. 2, an embodiment of a cylinder liner apparatus 100 includes an annular collar 120, a cylinder hull or housing 130, a replaceable sleeve 180, an elastomeric tube 190, and a retainer 160. A central axis 115 passes through the longitudinal center of cylinder liner assembly 100. Annular collar 120 is centered about central axis 115. Cylinder hull 130 is concentrically disposed within annular collar 120. Annular collar 120 secures apparatus 100 to a fluid side of a mud pump. In some embodiments, collar 120 is integral with cylinder hull 130 and in other embodiments collar 120 is a separate component from cylinder hull 130. Elastomeric tube 190 is concentrically disposed within cylinder hull 130. Replaceable sleeve 180 is concentrically disposed within elastomeric tube 190.

Cylinder hull 130 includes a hull bore 136, and comprises separate mating components including a first hull portion 132 and a second hull portion 160. First cylinder hull 132 includes a first end 134 and a second end 135. Second end 135 includes an annular, inner retainer 138. First cylinder hull 132 includes a bore 140 including a reduced inner diameter portion 142 forming a seat 144 at the second end 135. The annular, inner retainer 138 extends from the reduced inner diameter portion 142. First end 134 includes a reduced outer diameter portion or pin member 146 having a radially outwardly disposed annular groove 148 in which a seal 150 is disposed to sealingly engage first cylinder hull 132 with second cylinder hull 160. Further, pin 146 includes a radially outwardly disposed retainer recess 152.

Second hull portion 160 includes a first end 162 and a second end 164. Second cylinder hull 160 includes a bore 166 with a reduced inner diameter portion 168 forming a seat 170 at first end 162. Second end 164 includes an increased inner diameter portion or annular socket 172 that is slidingly engageable with pin 146 of first end 134 of first cylinder hull 132. Further, annular socket 172 includes access to a retainer hole 174 that extends through the annular collar 120 and into socket 172.

Elastomeric tube 190 includes a restrained end 192, a free end 194, an outer surface 195, and an inner bore 198. Elastomeric tube 190 may comprise any suitable elastic, compressible, and durable material including, without limitation, thermosets, thermoplastics, polymers, composites, or combinations thereof. In some embodiments, elastomeric tube 190 comprises an elastic, compressible, durable, low-friction and high strength Nitrile or Buna-N rubber. Further, elastomeric tube 190 includes an anti-extrusion ring 196 disposed on the outer surface 195 of the tube 190. Ring 196 may comprise any suitable rigid, durable material including, without limitation, metals or metal alloys (e.g., stainless steel, aluminum, etc.), polymer (e.g., polyethylene), composite, or combinations thereof. In some embodiments, ring 196 comprises a rigid, durable, low-friction and high strength metal alloy.

Replaceable sleeve 180 includes a restrained end 182 and a free end 184 which has an offset length $L_O$ relative to the longer free end 194 of elastomeric tube 190 that extends axially past the free end 184. In some embodiments, $L_O$ may be substantially zero or less than zero, i.e., free end 194 of elastomeric tube 190 may be at substantially the same axial location or at an axially inward location relative to the free end 184 of replaceable sleeve 180. Replaceable sleeve 180 includes a lead-in 186 at free end 184 with the potential of compensating for mechanical misalignment that is present in most mud pumps and further allows for compression of the piston seal during assembly. Further, replaceable sleeve 180 may comprise any suitable rigid, durable material including, without limitation, metals or metal alloys (e.g., stainless steel, aluminum, etc.), polymer (e.g., polyethylene), ceramic, composite, or combinations thereof. In some embodiments, replaceable sleeve 180 comprises a rigid, durable, low-friction and high strength metal alloy such as high chromium cast iron or a ceramic.

During assembly, elastomeric tube 190 is placed within bore 140 of first hull portion 132 such that restrained end 192 abuts seat 144. Sleeve 180 is placed through the bore 198 of sleeve 190 and into bore 142 of first cylinder hull 132 such that restrained end 182 abuts annular retainer 138 of second end 136 of first cylinder hull 132, thereby securing replaceable sleeve 180 in first cylinder hull 132. In another embodiment, sleeve 180 is placed within bore 198 of elastomeric tube 190 separately from the first hull portion 132. Then, the assembly of elastomeric tube 190 and sleeve 180 is placed within bore 140 of first cylinder hull 132 such that restrained end 192 of elastomeric tube 190 abuts seat 144 and sleeve end 182 is positioned within bore 142 of first cylinder hull 132 such that restrained end 182 abuts annular retainer 138 of second end 136 of first cylinder hull 132, thereby securing replaceable sleeve 180 in first cylinder hull 132.

Pin 146 of first hull portion 132 is inserted into annular socket 172 of second hull portion 160 while simultaneously the assembled sleeve 180 and tube 190 are slidingly received in the bore 166, such that free end 194 of elastomeric tube 190 contacts seat 170 of end 162. Thereby, the hull portions 132, 160 capture the sleeve 180 and the elastomeric tube 190, with the elastomeric tube 190 disposed between the sleeve 180 and the hull portions 132, 160. The loosely assembled hull portions 132, 160 include a relative compression length $L_C$. The position shown in FIG. 2 illustrates a cylinder liner apparatus 100 that is partially assembled and prior to compression of elastomeric tube 190, indicative of the steps in an embodiment of a method for replacement of replaceable sleeve 180. To impart radially compressive pre-load to replaceable sleeve 180, a force is applied to continue insertion of pin 146 into annular socket 172 causing compression of elastomeric tube 190 against seat 144. Anti-extrusion ring 196 prevents elastomeric tube 190 from extruding into annular socket 172.

Figure 3:
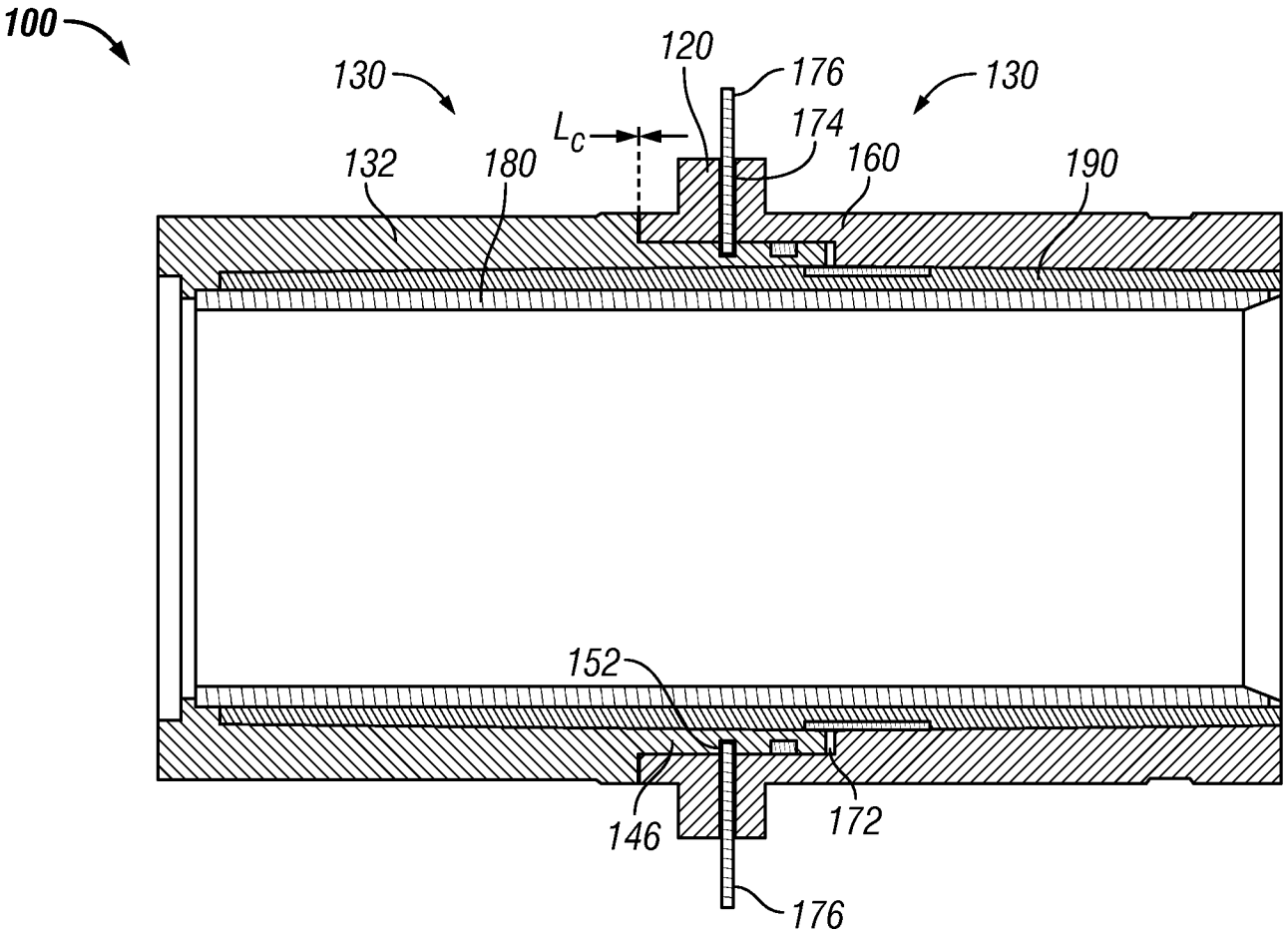
FIG. 3 shows a cross-sectional view of the cylinder liner apparatus employing a replaceable sleeve of FIG. 2, wherein the apparatus is in a fully assembled configuration.

Referring now to FIG. 3, pin 146 is forced into annular socket 172 until $L_C$ is zero and pin 146 is fully inserted into annular socket 172. Additionally, retainer recess 152 of first cylinder hull 132 aligns with retainer hole 174 of second cylinder hull 160 and one or more retainers 176 is inserted into both retainer recess 152 and retainer hole 174 to lock hull portions 132, 160 together to form the hull 130. In this manner, the hull portions 132, 160 are releasably coupled by the retainer 176 about the sleeve 180 with the tube 190 disposed in between. Insertion of pin 146 into annular socket 172 results in high compressive loading of elastomeric tube 190 between cylinder hull 130 and replaceable sleeve 180. Because elastomeric tube 190 is fully and closely contained, elastomeric tube 190 behaves as a very viscous fluid and distributes the axial compressive force of cylinder hulls 132, 160 as a substantially evenly distributed radial compressive force over replaceable sleeve 180. The force applied by elastomeric tube 190 against replaceable sleeve 180 results in a radially compressive pre-load in replaceable sleeve 180 and secures replaceable sleeve 180 within cylinder hull 130. The compressive stresses ensure that the sleeve resists cyclic fatigue due to the cyclic pressures of the operating pump sliding therein.

In the embodiments of cylinder liner apparatus 100 as shown in FIGS. 2 and 3, removal and replacement of replaceable sleeve 180 includes removing cylinder liner apparatus 100 from the fluid end of a mud pump. The next step includes removing one or more retainers 176 from cylinder hull 130 and separating first cylinder hull 132 from second cylinder hull 160 which necessitates removing pin 146 of first cylinder hull 132 from annular socket 172 of second cylinder hull 160. This step relieves the compressive loading of elastomeric tube 190, allowing it to return to an original length. In turn, the pressure applied by elastomeric tube 190 against cylinder hull 130 and replaceable sleeve 180 is relieved. At this point, replaceable sleeve may be exposed, accessed, and removed from cylinder hull 130 and replaced by another, unworn replaceable sleeve 180. In some embodiments, elastomeric tube 190 is removed along with replaceable sleeve 180 and is reused with an unworn replaceable sleeve 180. In some embodiments, elastomeric tube 190 is replaced by another, unworn elastomeric tube 190. Cylinder liner apparatus 100 is then assembled as shown in FIGS. 2-3 and described above. Thus, the only component of cylinder liner apparatus 100 that is discarded is sleeve 180, the only part that sustains damage during operation. The remaining components of cylinder liner apparatus 100 are reused.

It is intended that the embodiments of cylinder liner apparatus described herein are packaged in what is referred to as a replaceable sleeve cylinder liner system including the components of replaceable sleeve cylinder liner apparatus 100. Referring to FIG. 3, one embodiment of replaceable sleeve cylinder liner system includes annular collar 120, a cylinder hull 130 having first cylinder hull 132 and second cylinder hull 160, a replaceable sleeve 180, an elastomeric tube 190, and a retainer 176. In all embodiments of replaceable sleeve cylinder liner system shown in FIG. 3, sleeve 180 is removed and installed during the replacement process as a component of assembled replaceable sleeve cylinder liner system.

The use of an elastomeric tube (e.g., elastomeric tube 190) to apply radial compressive pre-load to a replaceable sleeve (e.g., replaceable sleeve 180) in the embodiments described above makes it possible for a single operator to remove and replace a worn or damaged replaceable sleeve. An additional benefit resulting from the use of elastomeric tube 190 to apply radial compressive pre-load to replaceable sleeve 180 includes minimizing the small annular space between the outer diameter of the pump piston and inner diameter of the cylinder liner, thus extending the useful service life of the piston. Further, the application of radial compressive pre-load on a replaceable sleeve by surrounding the sleeve with an elastomeric tube which behaves as a highly viscous fluid imparting pressure in a pseudo-hydraulic manner may be employed to eliminate the need for mechanically creating radial compressive pre-load on a sleeve. Alternatively, the method of creating radial compressive pre-load on a mud pump sleeve through the application of pressurized fluid may be combined with the mechanical components practiced in the prior art.

Figure 4:
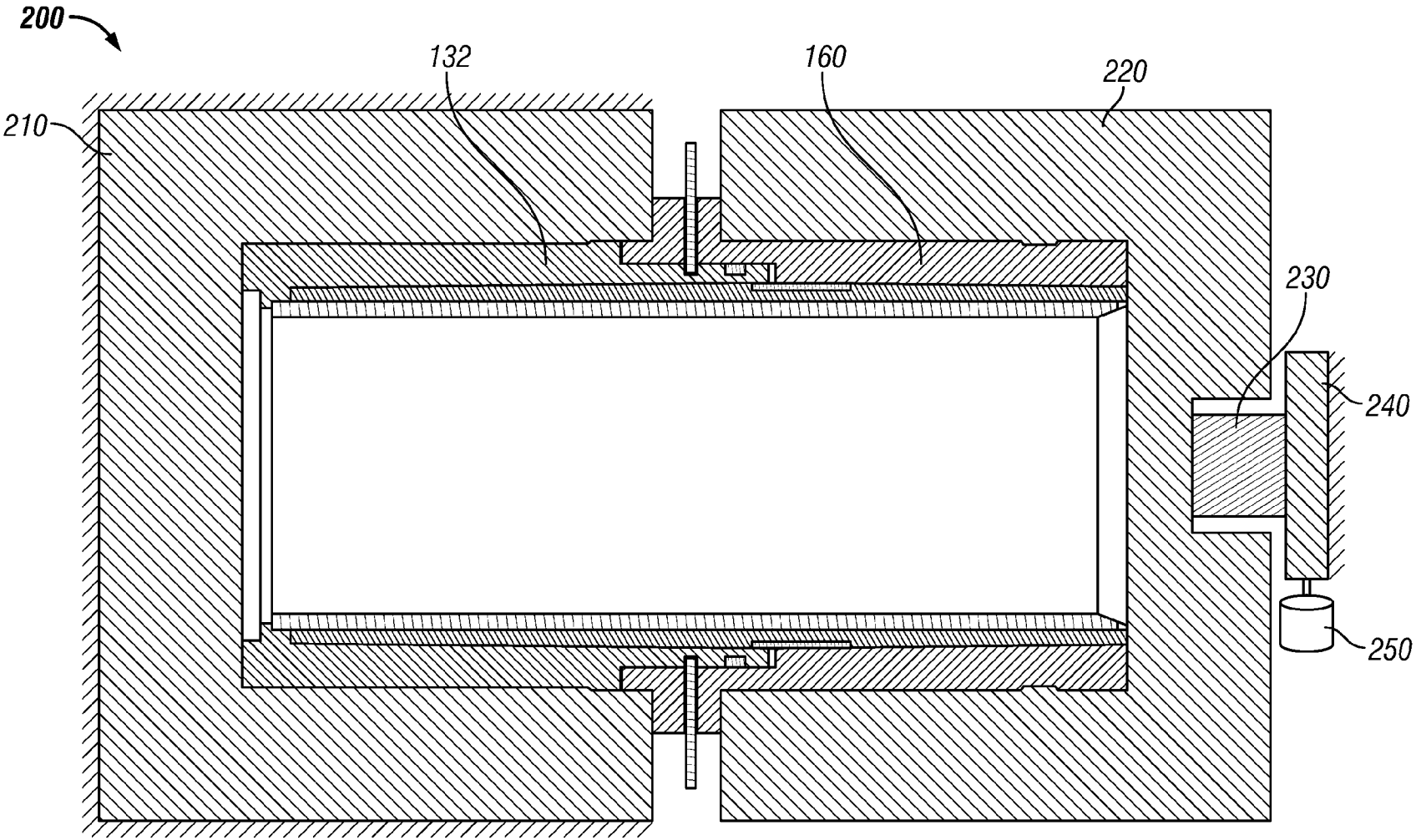
FIG. 4 shows a cross-sectional view of one embodiment of a hydraulic loading assembly of the present disclosure and a cylinder liner apparatus in a fully assembled configuration.

A cylinder liner apparatus (e.g., cylinder liner apparatus 100) comprising a replaceable sleeve offers the potential for relatively inexpensive material and manufacturing costs, while permitting replacement of only one worn part, namely a replaceable sleeve. Thus, a cylinder liner apparatus of this disclosure allows reuse of the remainder of the cylinder liner apparatus and facilitates use of an economically-advantageous disposable replaceable sleeve. In this way, cylinder liner apparatus of this disclosure allow for a replaceable sleeve to be replaced in the field. Moreover, the compressive makeup force for cylinder liner apparatus of this disclosure can be applied at the pump when the replaceable sleeve is changed or at a separate work station at the well site. If the compressive makeup force is applied at the pump, a custom designed hydraulic loading assembly 200 is used, as shown in FIG. 4. Loading assembly 200 includes a first housing 210 that is stationary and captures first cylinder hull 132 and a second housing 220 that is moveable and captures second cylinder hull 160. Further, loading assembly 200 includes a hydraulic cylinder 230 connected to a stationary base 240 and a hydraulic source 250.

Thus, as taught herein, embodiments of a mud pump cylinder liner apparatus include a cylinder housing including a first hull portion and a second hull portion, and a replaceable sleeve disposed in the cylinder housing, wherein the first and second hull portions are releasably coupled to capture the replaceable sleeve in the cylinder housing, and wherein the first and second hull portions are releasable to provide access to the replaceable sleeve. The apparatus may further include an elastomeric material disposed between the replaceable sleeve and the first and second releasably coupled hull portions. The apparatus may further include an elastomeric tube disposed about the replaceable sleeve. The releasably coupled first and second hull portions may apply a compressive pressure to the elastomeric material creating radial compressive stress in the replaceable sleeve. The elastomeric tube may include a restrained end disposed within the hull portion and a free end disposed within the second hull portion, and the replaceable sleeve may include a restrained end disposed within the restrained end of the elastomeric tube and a free end disposed within the free end of the elastomeric tube, wherein a compressive pressure applied by the releasably coupled hull portions reacts the elastomeric tube free end and creates radial compressive stress in the replaceable sleeve. The apparatus may further include a retainer coupled between the first and second hull portions to maintain the coupling. The retainer may be removable to release the first and second hull portions and expose the replaceable sleeve. The first hull portion may include a pin member slidingly engageable in an annular socket of the second hull portion. The apparatus may further include an annular collar disposed on an outer portion of the cylinder housing. The replaceable sleeve may be configured to receive a pump piston.

In certain embodiments, a pump cylinder liner apparatus includes a first cylinder hull portion, a second cylinder hull portion, a replaceable sleeve, and an elastomeric tube disposed about the replaceable sleeve, wherein the first and second cylinder hull portions are releasably coupled to capture the replaceable sleeve and compress the elastomeric tube. The compressed elastomeric tube may impart a radially compressive pre-load to the replaceable sleeve.

In other embodiments, a method for replacing a sleeve in a pump cylinder liner apparatus includes providing a cylinder housing with a first hull portion and a second hull portion, capturing a replaceable sleeve between the first and second hull portions, and releasably coupling the first and second hull portions about the replaceable sleeve. The method may further include releasing the first and second hull portions to expose the replaceable sleeve and removing the replaceable sleeve. The method may further include inserting another replaceable sleeve between the first and second hull portions, re-capturing the other replaceable sleeve between the first and second hull portions, and re-coupling the first and second hull portions about the other replaceable sleeve. The method may further include disposing an elastomeric material between the replaceable sleeve and the first and second hull portions and compressing the elastomeric material as a result of capturing the replaceable sleeve and releasably coupling the first and second hull portions about the replaceable sleeve. The elastomeric material may be an elastomeric tube disposed about the replaceable sleeve. The method may further include imparting a radially compressive pre-load to the replaceable sleeve as a result of compressing the elastomeric material. The method may further include capturing an elastomeric tube between the replaceable sleeve and the first and second hull portions and compressing the elastomeric tube about the replaceable sleeve to pre-load the sleeve.

While embodiments of this disclosure have been shown and described, modifications thereof can be made by one skilled in the art without departing from the scope or teaching of this disclosure. The embodiments described herein are exemplary only and are not limiting. Because many varying and different embodiments may be made within the scope of the present teachings, including equivalent structures or materials hereafter thought of, and because many modifications may be made in the embodiments herein detailed in accordance with the descriptive requirements of the law, it is to be understood that the details herein are to be interpreted as illustrative and not in a limiting sense. It is to be especially understood that the substitution of a variant of a claimed element or feature, without any substantial resultant change in the working of the apparatus, will not constitute a departure from the scope of the disclosure.

What is claimed is:

1. A pump cylinder liner apparatus comprising:

a cylinder housing including a first hull portion and a second hull portion; and a replaceable sleeve disposed in the cylinder housing;

wherein the first and second hull portions are directly and releasably coupled to capture the replaceable sleeve in the cylinder housing;

wherein the first and second hull portions are releasable to expose the replaceable sleeve; and an elastomeric material disposed between the replaceable sleeve and the first and second releasable coupled hull portions;

wherein the releasably coupled first and second hull portions apply a compressive pressure to the elastomeric material creating radial compressive stress in the replaceable sleeve.

2. The apparatus of claim 1 further comprising an elastomeric tube disposed about the replaceable sleeve.

3. The apparatus of claim 2 wherein:

the elastomeric tube includes a restrained end disposed within the first hull portion and a free end disposed within the second hull portion; and the replaceable sleeve includes a restrained end disposed within the restrained end of the elastomeric tube and a free end disposed within the free end of the elastomeric tube;

wherein the compressive pressure applied by the releasably coupled first and second hull portions reacts the elastomeric tube free end and creates the radial compressive stress in the replaceable sleeve.

4. The apparatus of claim 1 further comprising a retainer coupled between the first and second hull portions to maintain the coupling.

5. The apparatus of claim 4 wherein the retainer is removable to release the first and second hull portions and expose the replaceable sleeve.

6. The apparatus of claim 1 wherein the first hull portion comprises a pin member slidingly engageable in an annular socket of the second hull portion.

7. The apparatus of claim 1 further comprising an annular collar disposed on an outer portion of the cylinder housing.

8. The apparatus of claim 1 wherein the replaceable sleeve is configured to receive a pump piston.

9. The pump cylinder liner apparatus of claim 1, wherein the second hull portion is releasable only from the first hull portion to expose the replaceable sleeve.

10. A pump cylinder liner apparatus comprising:

a first cylinder hull portion;

a second cylinder hull portion;

a replaceable sleeve; and an elastomeric tube disposed about the replaceable sleeve;

wherein the first and second cylinder hull portions are directly and releasable coupled to capture the replaceable sleeve and compress the elastomeric tube;

wherein the elastomeric tube includes a restrained end disposed within the first cylinder hull portion and a free end disposed within the second cylinder hull portion;

wherein the replaceable sleeve includes a restrained end disposed within the restrained end of the elastomeric tube and a free end disposed within the free end of the elastomeric tube; and wherein a compressive pressure applied by the releasable coupled first and second hull portions reacts the free end of the elastomeric tube and creates radial compressive stress in the replaceable sleeve.

11. The apparatus of claim 10 wherein the radial compressive stress is a pre-load on the replaceable sleeve.

12. A method for replacing a sleeve in a pump cylinder liner apparatus comprising:

providing a cylinder housing with a first hull portion and a second hull portion;

capturing a replaceable sleeve between the first and second hull portions;

directly and releasably coupling the first and second hull portions about the replaceable sleeve;

disposing an elastomeric material between the replaceable sleeve and the first and second hull portions; and compressing the elastomeric material as a result of capturing the replaceable sleeve and releasably coupling the first and second hull portions about the replaceable sleeve.

13. The method of claim 12 further comprising:

releasing the first and second hull portions to expose the replaceable sleeve; and removing the replaceable sleeve.

14. The method of claim 13 further comprising:

inserting another replaceable sleeve between the first and second hull portions;

re-capturing the other replaceable sleeve between the first and second hull portions; and re-coupling the first and second hull portions about the other replaceable sleeve.

15. The method of claim 12 wherein the elastomeric material is an elastomeric tube disposed about the replaceable sleeve.

16. The method of claim 12 further comprising imparting a radially compressive pre-load to the replaceable sleeve as a result of compressing the elastomeric material.

17. The method of claim 12 further comprising:

capturing an elastomeric tube between the replaceable sleeve and the first and second hull portions; and compressing the elastomeric tube about the replaceable sleeve to pre-load the sleeve.

18. The method of claim 12, further comprising releasing the second hull portion from the first hull portion in a single step to expose the replaceable sleeve.

* * * * *